US006523719B2

(12) United States Patent
Trulaske, Sr.

(10) Patent No.: US 6,523,719 B2
(45) Date of Patent: Feb. 25, 2003

(54) CONTAINER DISPENSER FOR MERCHANDISER

(75) Inventor: Steven L. Trulaske, Sr., Ladue, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 42 days.

(21) Appl. No.: 09/729,480

(22) Filed: Dec. 4, 2000

(65) Prior Publication Data

US 2002/0066744 A1 Jun. 6, 2002

(51) Int. Cl.[7] ..... B65G 59/00

(52) U.S. Cl. ..... 221/301; 211/59.2; 211/74; 221/312 R

(58) Field of Search ..... 221/150 R, 301, 221/299, 312 R, 312 A; 211/59.2, 74, 162

(56) References Cited

U.S. PATENT DOCUMENTS

| | | | | | |
|---|---|---|---|---|---|
| 2,071,771 | A | | 2/1937 | Shield | 186/3 |
| 2,270,908 | A | | 1/1942 | Smith | 312/48 |
| 2,620,691 | A | | 12/1952 | Gould | 81/3.1 |
| 2,772,787 | A | | 12/1956 | Lee | 211/75 |
| 3,034,684 | A | | 5/1962 | Jackson | 221/251 |
| 3,243,220 | A | | 3/1966 | Karas | 294/87.28 |
| 4,022,363 | A | | 5/1977 | Eliassen | 224/45 |
| 4,235,351 | A | | 11/1980 | Kölbl et al. | 221/92 |
| 4,300,704 | A | | 11/1981 | Funke et al. | 221/301 |
| 4,310,097 | A | | 1/1982 | Merl | 211/49 |
| 4,367,818 | A | | 1/1983 | Suttles | 211/49 |
| 4,401,221 | A | | 8/1983 | Suttles | 211/49 |
| 4,423,816 | A | | 1/1984 | Suttles | 211/183 |
| 4,526,097 | A | | 7/1985 | Cound | 100/215 |
| 4,592,377 | A | | 6/1986 | Paulsen et al. | 133/5 |
| 5,000,393 | A | | 3/1991 | Madesen | 242/55.3 |
| 5,209,358 | A | | 5/1993 | Simard | 211/74 |
| 5,533,632 | A | | 7/1996 | Patterson et al. | 211/122 |
| 5,586,665 | A | | 12/1996 | Brousseau | 211/59.2 |
| 5,586,687 | A | | 12/1996 | Spamer et al. | 221/298 |
| 5,669,527 | A | | 9/1997 | Hardy | 221/191 |
| 5,695,074 | A | | 12/1997 | Wiese | 211/59.2 |
| 5,706,956 | A | | 1/1998 | Headrick et al. | 211/59.2 |
| 5,706,957 | A | | 1/1998 | Hardy | 211/59.2 |
| 5,718,341 | A | | 2/1998 | Robertson | 211/59.2 |
| 5,788,091 | A | | 8/1998 | Robertson et al. | 211/59.2 |
| 5,947,303 | A | * | 9/1999 | Robolin | 211/74 |
| 6,032,475 | A | | 3/2000 | Tolfsen | 62/256 |
| 6,059,125 | A | * | 5/2000 | Parham | 211/74 |
| 6,073,785 | A | * | 6/2000 | Tolfsen | 211/74 |
| 6,360,901 | B1 | * | 3/2002 | Parham | 211/74 |

* cited by examiner

*Primary Examiner*—H. Grant Skaggs
(74) *Attorney, Agent, or Firm*—Polster, Lieder, Woodruff & Lucchesi LC.

(57) ABSTRACT

A merchandiser dispensing assembly for bottles having a cap and an integral neck flange, the assembly including a track having opposed rails receiving the neck flange in suspended sliding relation and a bottle engageable stop portion at the front end. A gate member is pivotally mounted at the front end adjacent one of the rails of the track to retain a rearward group of bottles in spaced relation from the first bottle. Removal of the first bottle permits the gate member to move out of the path of the group and allow the first bottle of the group to move into the position occupied by the removed bottle. The track includes hangers holding the rails apart and being attachable to forward and rearward transverse supports to hold the track in an inclined position to permit gravity feed of the bottles.

19 Claims, 6 Drawing Sheets

CONTAINER DISPENSER FOR MERCHANDISER

BACKGROUND OF THE INVENTION

This invention relates generally to a dispenser rack for containers such as plastic bottles and more particularly to a track for suspending bottles by the neck for gravity feed having a pivoted gate assembly and a bottle engageable stop at the front exit end. In general, the gate assembly is pivotally mounted to control delivery of a rearward group of bottles spaced from a forwardly disposed bottle to release a bottle from the group when the foremost bottle is removed from the track by a consumer.

Merchandisers having track systems for holding bottles suspended by the neck and having a pivoted gate or rocker assembly providing at the forward end to control the dispensing of the bottles are not in themselves new. Two reference patents are particularly pertinent in the prior art. The first reference is U.S. Pat. No. 5,586,687 which discloses a bottle dispenser having a track with a spring biased transverse stop at the front end to maintain the foremost of a set of flanged neck bottles while the rest of the bottles are disposed in a group spaced from the foremost bottle at the rear end of the gate assembly. A pivoted gate assembly, engageable at its front end by the foremost bottle, is moved into the path of the group of bottles to hold them in place. Removal of the foremost bottle pivots the gate assembly out of the path of the first of the spaced group of bottles so that the foremost bottle of the group slides down the track under gravity to take the place of the removed bottle and move the rear end of the gate into a position holding the remainder of the group in place.

The track is provided by a large, heavy channel and the gate is somewhat complicated to include a rocker member movable in the vertical plane and pin-mounted in an inclined slot or in a member having an auxiliary element suspended at the rear end. This arrangement is complicated and consequently expensive to produce.

The second reference is U.S. Pat. No. 6,073,785. This patent discloses a track having a front end stop which is in the form of a downwardly and backwardly oriented slot configurated to receive the bottle flange. This arrangement requires the customer to manipulate the bottle for removal. The gate mechanism includes a flat horizontally arranged plate having a configuration engageable by the bottle cap to control movement of the gate into the path of a group of bottles to hold the bottles in place. In this reference the stop, the gate and the track tend to be complicated and therefore expensive to manufacture.

The present dispenser overcomes these and other problems in a manner not revealed by the known prior art.

SUMMARY OF THE INVENTION

This dispensing system for bottle containers having a cap and a neck flange includes a simple track of spaced rails held apart by U-shaped members and having an upwardly extending built-in stop at the forward end. A transverse support system is provided by cross members receiving the track U-shaped members in hanging relation. A gate assembly at the forward end of the spaced rails is mounted by a vertical pivot to provide a flat face to control the dispensing of the suspended bottles.

This invention provides a merchandiser dispensing assembly for bottles having a cap and a neck flange, the assembly comprises a track including opposed rail members spaced apart a distance less than the diameter of the neck flange to support the bottles in sliding relation and the rail including a front end and a rear end; and a stop portion at the front end engagable by a first bottle: a gate member having a front end and a rear end and being pivotally mounted adjacent one of said rail members for movement of the front end out of the rail path while the rear end moves into the rail path whereby engagement of the front end of the gate member by said first bottle moves the rear end of the gate member into the path of a second, subsequent bottle to engage said subsequent bottle to arrest movement of said subsequent bottle a predetermined distance from said first bottle; support means for supporting the track in inclined relation tending to gravity feed the bottles toward the front end of the track.

It is an aspect of this invention to provide that the support means front and rear support members each including a plurality of support members; and the track includes U-shaped hangers holding the rails apart and being attachable to associated support members.

It is another aspect of the invention to provide that the support members each include a plurality of bracket hooks engageable by associated U-shaped hangers.

It is yet another aspect of the invention to provide that each rail is upwardly turned at the front end to provide the stop portion.

Still another aspect of the invention is to provide that the gate member includes front and rear bottle engageable cam portions and an intermediate pivot means; and for operatively mounting the gate member to the rail member.

It is another aspect of the invention to provide that spring means biases the gate member rear end into the path of the track.

It is yet another aspect of the invention to provide that one of said rail members includes a pivot post; said gate member is mounted to said post in pivotal relation.

It is still another aspect of the invention to provide that torsion means mounted to said post biases said gate member rear end into the path of said track.

It is an aspect of the invention to provide that the gate member includes front and rear portions and intermediate pivot means; the gate member rear end portion includes spaced limit means engageable with the rail member to limit movement of the gate member as it rotates about the pivot means.

This dispensing system is simple and inexpensive to manufacture, easy to install and very efficient in operation.

DESCRIPTION OF THE PREFERRED EMBODIMENT

Figure 1:
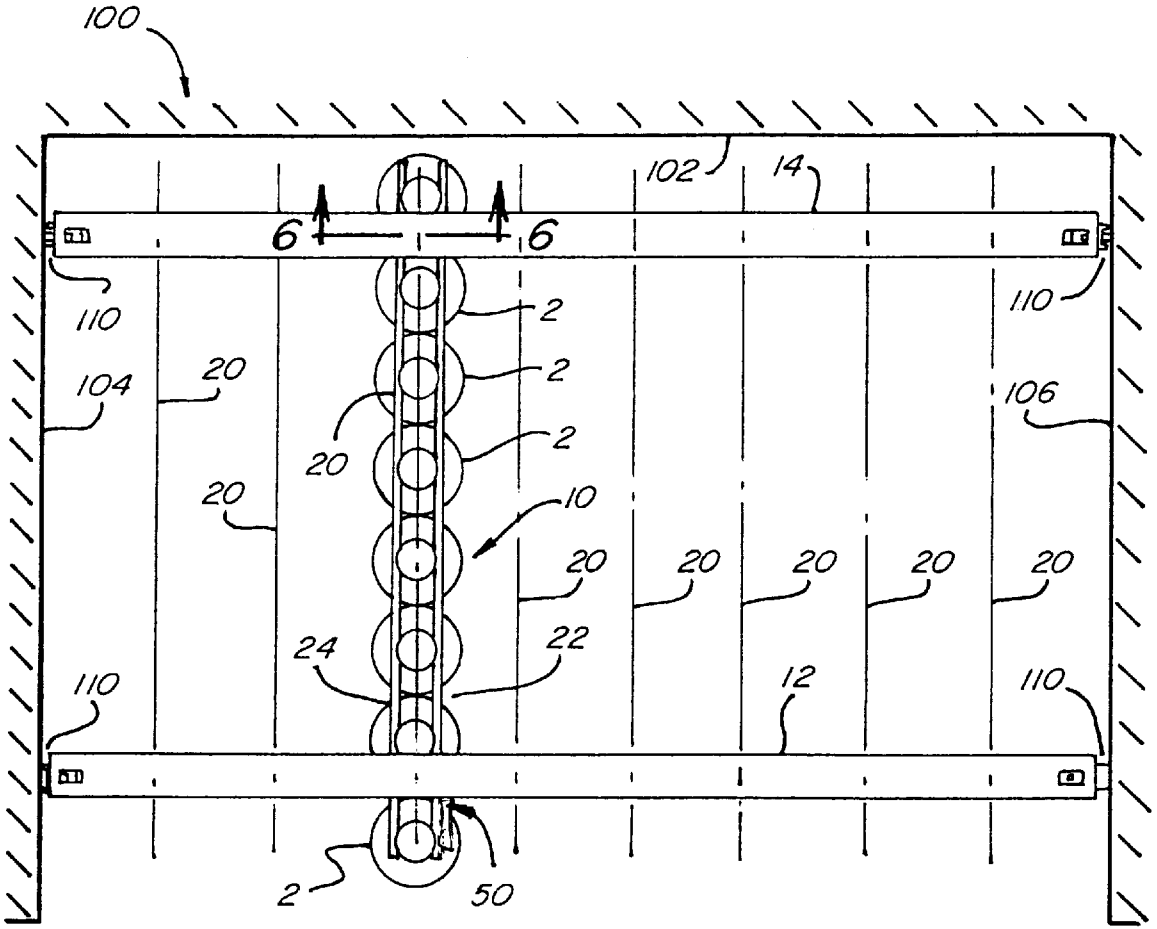
FIG. 1 is a fragmentary plan view of the rack assembly.
Figure 2:
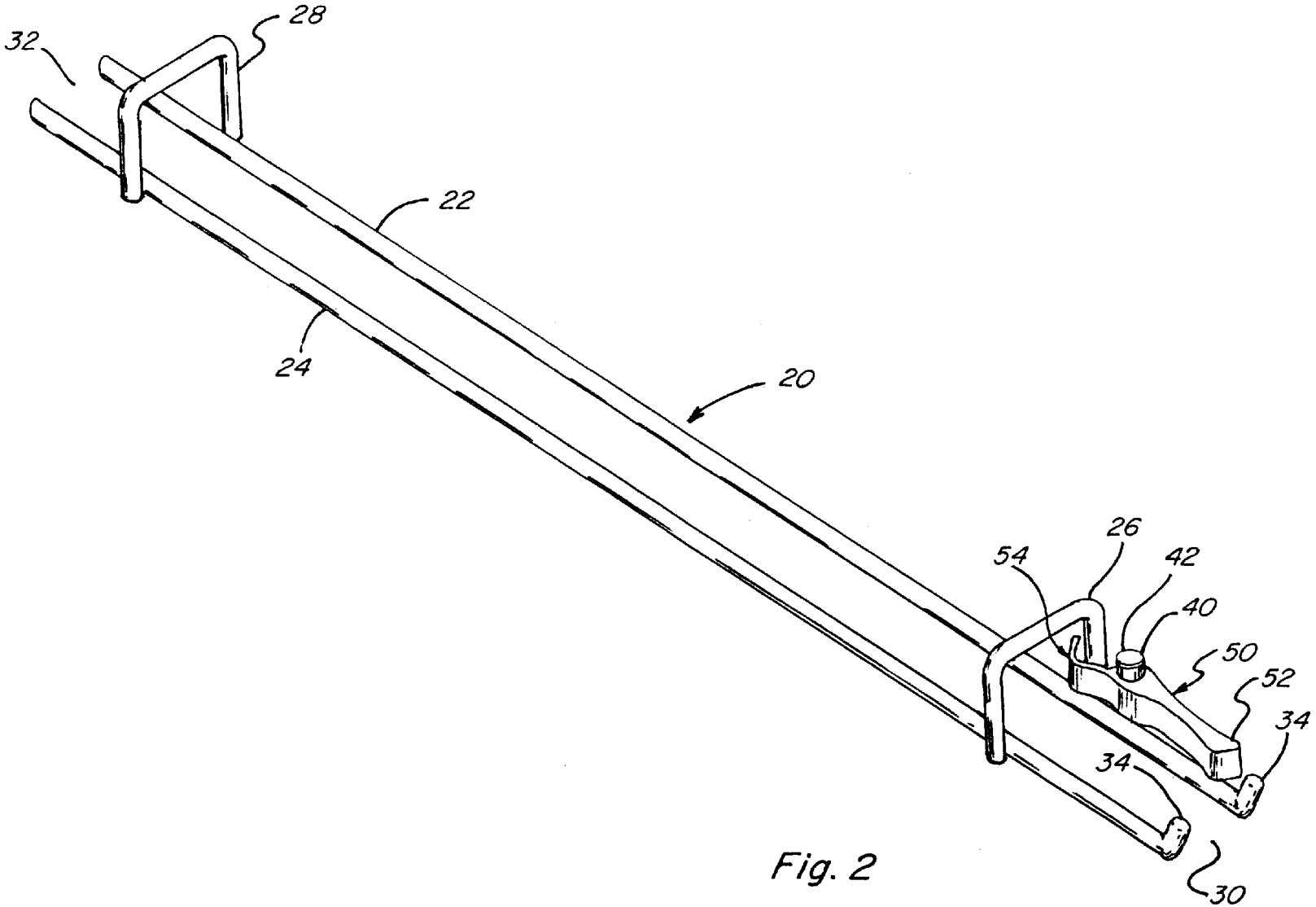
FIG. 2 is a perspective view of a track assembly.
Figure 5:
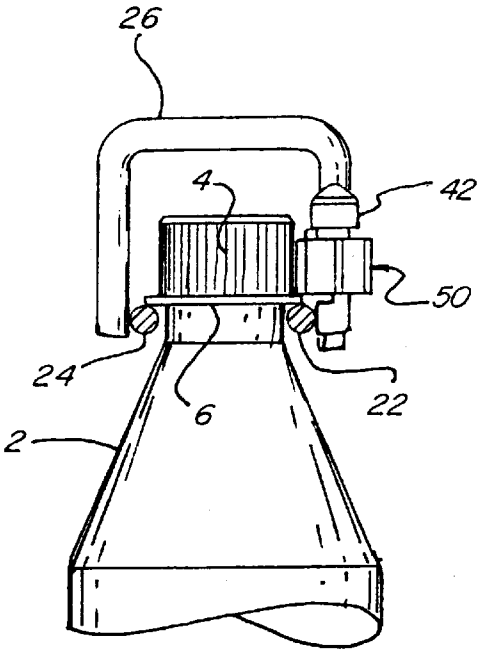
FIG. 5 is a cross-sectional view taken on Line 5—5 of FIG. 1.

Referring now by reference numerals to the drawings and first to FIGS. 1 and 2, it will be understood that the dispensing assembly provides a rack generally indicated by numeral 10 and mounted in a merchandiser 100 for the purpose of storing and dispensing beverage containers, such as 20-ounce soda bottles indicated by numeral 2, of the type having a screw top cap 4 and an integral annular flange 6 disposed below the cap.

Merchandisers 100 for dispensing beverages are well-known and need not be described in detail. The merchandiser cabinet includes essentially a rear wall 102, side walls 104 and 106 and is generally provided with a swinging glass door (not shown). The dispensing assembly rack 10, in the embodiment shown, includes front and rear supports 12 and 14 extending between side walls 104 and 106 and supported on end brackets 110. The supports 12 and 14 are identical except that they are mounted at different elevations to provide support for an inclined set of tracks 20. Each set of tracks 20 is disposed between the rear wall 102 and the glass door.

Figure 7:
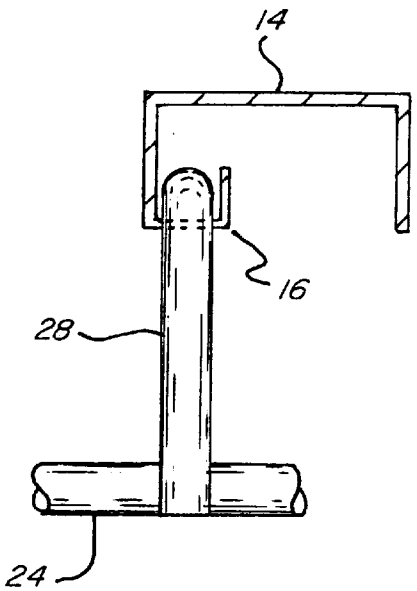
FIG. 7 is a cross-sectional view taken on Line 7—7 of FIG. 6.
Figure 6:
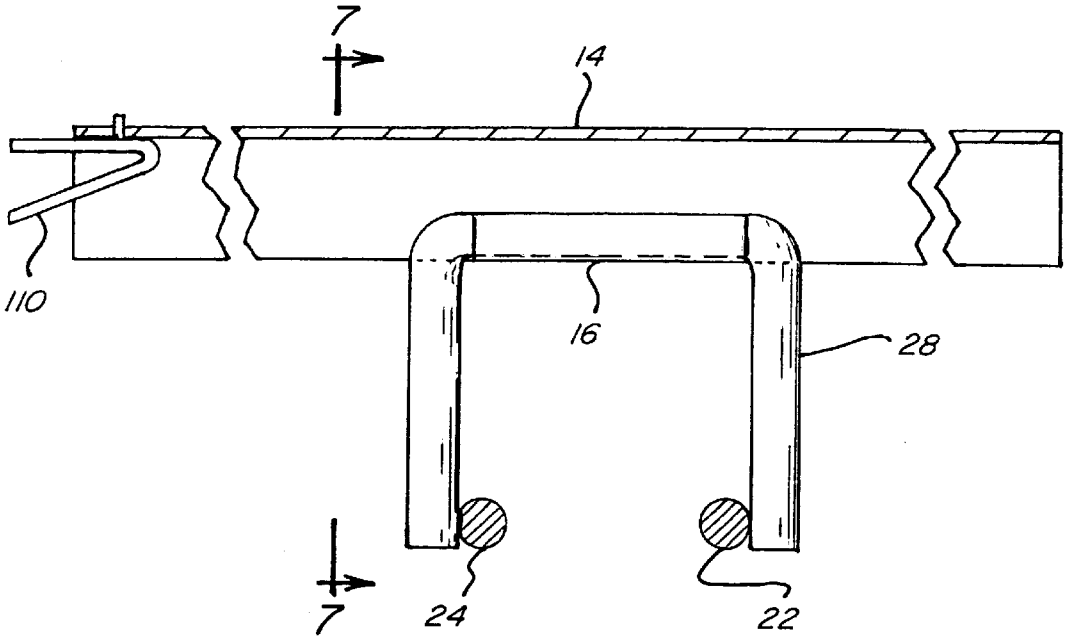
FIG. 6 is a sectional view taken on Line 6—6 of FIG. 1.

As best shown in FIGS. 6 and 7, the front and rear cross supports 12 and 14 are channel members and each includes a plurality of inwardly integrally formed hook brackets 16. Each set of tracks 20 includes opposed rail members 22 and 24 which are connected together by means of front and rear inverted U-shaped hangers 26 and 28, respectively, which are carried by the hook brackets 16. In the embodiment shown, the track members 22 and 24 and the hangers 26 and 28 are formed from heavy wire such as ¼" diameter steel rods welded or otherwise attached to each other. Also, the rods are provided with a low friction coating and the 1:8 inclination is sufficient that the bottles mounted to the track slide easily at this inclination.

Figure 3:
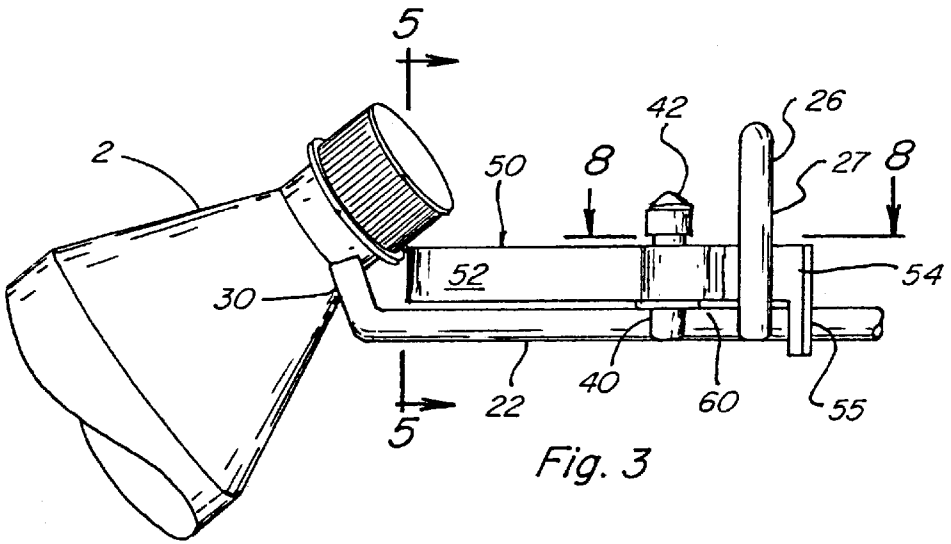
FIG. 3 is an elevational view of the track front end showing the gate.
Figure 4:
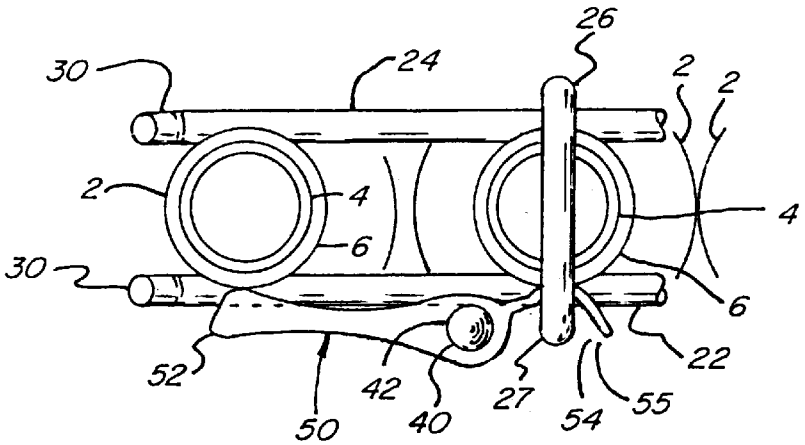
FIG. 4 is a plan view of track front end.

As best shown in FIGS. 3 and 4, the rail members 22 and 24 are disposed in side-by-side relation to provide an inside dimension less than the diameter of the annular flanges 6 of the bottles 2 so that the bottle flanges ride easily on the rail 22 and 24. The track 20 is open at the front end 30 and at the rear end 32, and each rail member 22 and 24 is turned upwardly to provide a stop 34 engagable by the bottle flange 6. Adjacent rail member 22 is a vertical post 40.

A gate 50 is mounted to the post 40 in pivotal relation and the gate 50 includes a front end 52, a rear end 54 and an intermediate pivot portion 56, which is welded, or otherwise attached, to the gate 50 to provide the pivotal mounting of said gate 50 to said post 40. The gate 50 may be of plastic, as shown, or steel having a low friction coating.

Figure 8:
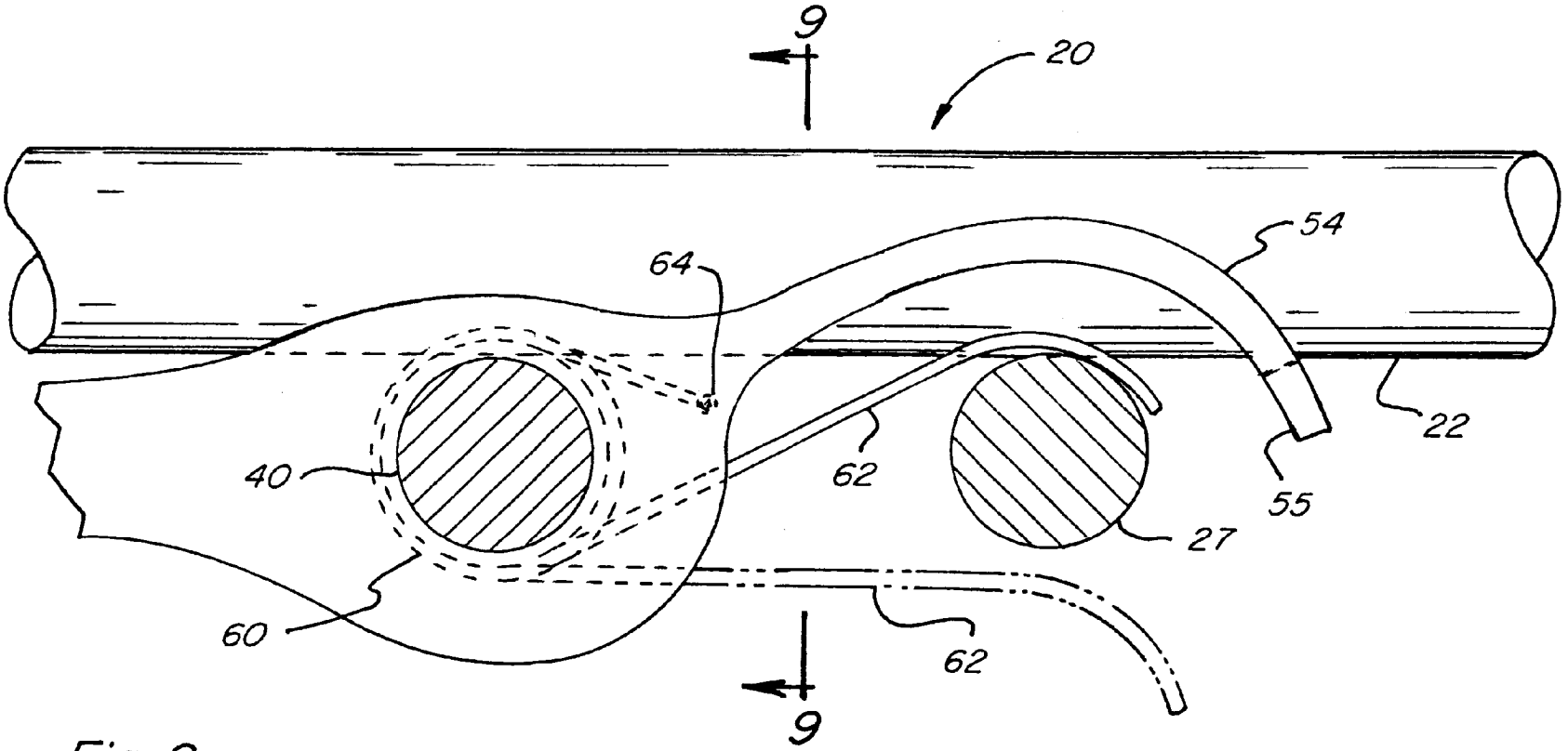
FIG. 8 is an enlarged plan view showing the torsion spring arrangement.
Figure 9:
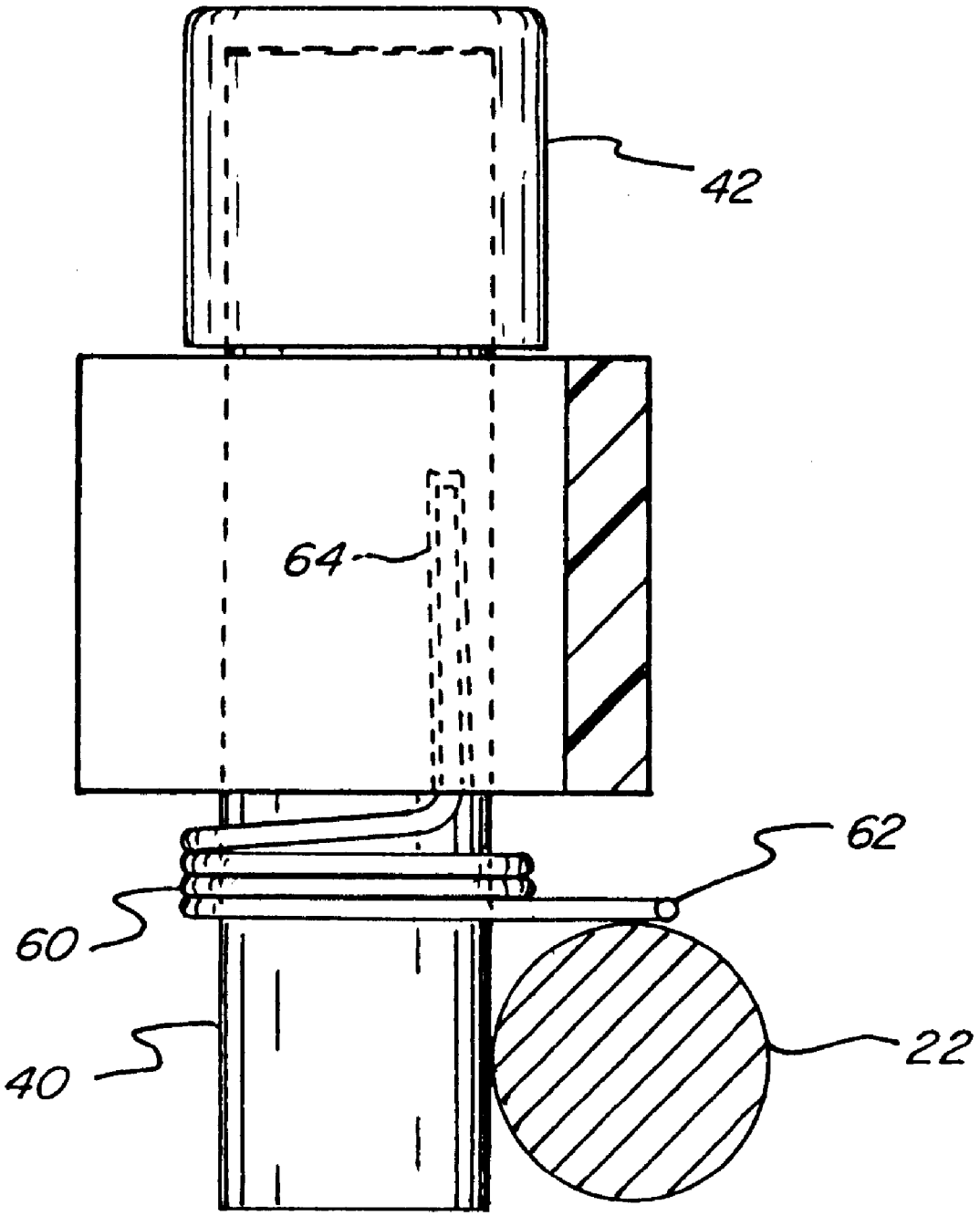
FIG. 9 is a cross sectional view of the torsion spring arrangement.

The gate front end 52 is curved to provide a camming surface engageable by a bottle cap 4 tending to swing the gate 50 counterclockwise. The gate rear end 54 is also curved to provide a camming surface engageable by a bottle cap 4 tending to swing the gate 50 in a clockwise direction. As best shown in FIG. 4, the rear end 54 of the gate is disposed adjacent a leg 27 of the U-shaped hanger 26 to limit movement of the gate in a clockwise direction. The rear end 54 of the gate also includes a downwardly depending stop element 55 to limit movement of the gate in a counterclockwise direction. In the embodiment shown, the post 40 is provided with a cap 42 tending to prevent uplift of the gate on said post. Also, the gate 50 is spring loaded by means of a torsion spring 60 shown in FIG. 8 and FIG. 9 having outstanding arm 62 and upstanding arm 64. The torsion spring 60 is shown in broken lines as freely mounted to the post prior to loading the outstanding arms 62 and 64. When tensioned, the spring arm 62 is moved in the position shown in FIG. 8 in which the horizontally curved arm 62 rearwardly disposed about the vertical arm 27 of the hanger 26 and the vertically outstanding arm 64 is received within a vertical opening provided in the gate 50 and in effect the spring seats on the torsion spring as shown in FIG. 9. Because of the torsion spring, the gate 50 is biased in a counterclockwise direction in which the depending post 55 on the gate 50 is urged against the rail member 22.

It is thought that the structural features and functional advantages of the dispensing system rack 10 has become fully apparent from the foregoing description of parts. However, for completeness of disclosure, the installation and operation of the system will be briefly described.

The rack assembly 10 is installed within the merchandiser 100 by hanging each track 20 between the rear support channel 14 and the front support channel 12, the front support 12 being at an elevation about 2 inches lower than the rear support 14 and the support channels being about sixteen inches apart to provide the necessary inclination of about 1:8.

When the tracks 20 are mounted to the supports 12 and 14 is a simple matter to emplace bottles 2 from the front end against the pivotially mounted, spring biased, gate member, the front end of the gate engaged by the bottle cap is pushed in a counterclockwise direction tending to move out of the path of the bottle. When the bottles are pushed rearwardly from the front end of the gate they slide easily past the rear end of the gate which swings in a clockwise direction and then, by virtue of the torsion spring, in a counterclockwise direction to block return of the bottles.

When the track 20 is fully loaded, the last bottle is retained at the front end of the gate. When the gate is engaged by the foremost bottle, the bottle prevents the gate from moving clockwise and the rear end of the gate is maintained in a position in which it blocks downward movement of the group of bottles rearward of the gate. In this way, while succeeding bottles are urged against each other, the foremost bottle engaging the stop is free of the weight of succeeding bottles. When the foremost bottle is removed by a customer, the gate is allowed to move in a clockwise direction by the pressure of first bottle of the group against the relatively light resistance of the torsion spring 60, thereby releasing the first held bottle of the rear group which slides down the track to take the place of the removed bottle and pushes the front end of the gate counterclockwise into the path of the next bottle which is held in place by the rear end of the gate.

Also although the improved dispensing system has been described by making particular reference to a preferred construction, the details of description are not to be understood a restrictive, numerous variants being possible within the scope of the claims hereunto appended.

I claim:

1. A merchandiser dispensing assembly for bottles having a cap and a neck flange, the assembly comprising:

(a) a track including opposed rail members spaced apart a distance less than the diameter of the neck flange to define a rail path and to support the bottles in sliding relation and the track including a front end and a rear end; and a stop portion at the front end engagable by a first bottle;

(b) a gate member having a front end and a rear end and being pivotally mounted adjacent one of said rail members for movement of the front end out of the rail path while the rear end moves into the rail path whereby engagement of the front end of the gate member by said first bottle moves the rear end of the gate member into the path of a second, subsequent bottle to engage said subsequent bottle to arrest movement of said subsequent bottle a predetermined distance from said first bottle; and (c) support means for supporting the track in inclined relation tending to gravity feed the bottles toward the front end of the track;

(d) the support means including front and rear support members each including a plurality of support members; and (e) the track including U-shaped hangers holding the rails apart and being attachable to associated support members.

2. A dispensing assembly as defined in claim 1, wherein:

(f) the support members each includes a plurality of bracket hooks engageable by associated U-shaped hangers.

3. A dispensing assembly as defined in claim 1, wherein:

(d) each rail is upwardly turned at the front end to provide the stop portion.

4. A dispensing assembly as defined in claim 1, wherein:

(d) the gate member includes front and rear bottle engageable cam portions and an intermediate pivot means; and for operatively mounting the gate member to the rail member.

5. A dispensing assembly as defined in claim 1, wherein:

(d) spring means biases the gate member rear end into the path of the track.

6. A dispensing assembly as defined in claim 1, wherein:

(d) one of said rail members includes a pivot post;

(e) said gate member is mounted to said post in pivotal relation.

7. A dispensing assembly as defined in claim 6, wherein:

(f) torsion means mounted to said post biases said gate member rear end into the path of said track.

8. A dispensing assembly as defined in claim 1, wherein:

(d) the gate member includes front and rear portions and intermediate pivot means;

(e) the gate member rear end portion includes spaced limit means engageable with the rail member to limit movement of the gate member as it rotates about the pivot means.

9. A merchandiser dispensing assembly for bottles having a cap and a neck flange, the assembly comprising:

(a) a track including opposed rail members spaced apart a distance less than the diameter of the neck flange to define a rail path and to support the bottles in sliding relation and the track including a front end and a rear end; and a stop portion at the front end engageable by a first bottle;

(b) a gate member having a front end and a rear end and being pivotally mounted adjacent one of said rail members for movement of the front end out of the rail path while the rear end moves into the rail path whereby engagement of the front end of the gate member by said first bottle moves the rear end of the gate member into the path of a second, subsequent bottle to engage said subsequent bottle to arrest movement of said subsequent bottle a predetermined distance from said first bottle; and (c) support means for supporting the track in inclined relation tending to gravity feed the bottles toward the front end of the track;

(d) the rail members including front and rear U-shaped hanger portions having arm portions attached to associated rail members and the rail members are turned upwardly at the ends to provide bottle engageable stops;

(e) one of said rail members including a pivot post disposed in longitudinally spaced relation from said hanger member arm and mounting said gate member in pivotal relation; and (f) the gate member including front and rear bottle engageable cam portions and the rear end spaced limit means one of said limit means being provided by the end portion engaging said hanger member arm and the other of said limit means being provided by a depending gate portion engaging said adjacent rail member.

10. A dispensing assembly as defined in claim 9, wherein:

(g) a torsion spring is mounted to said pivot post having one end engageable with said hanger arm and the other end engageable with said gate, said torsion spring tending to urge said gate rear end into the bottle path.

11. A merchandiser dispensing assembly for bottles having a cap and a neck flange, the assembly comprising:

(a) a track including opposed rail members spaced apart a distance less than the diameter of the neck flange to define a rail path and to support the bottles by the neck flange in sliding relation and the track including a front end and a rear end and a stop portion at the front end engageable by a first bottle;

(b) a gate member having a front end and a rear end and a post attached to one of the bottle-supporting rail members wherein the gate member is pivotally mounted upon the post for movement of the front end out of the rail path while the rear end moves into the rail path whereby engagement of the front end of the gate member by the first bottle moves the rear end of the gate member into the path of a second, subsequent bottle to engage the subsequent bottle to arrest movement of the subsequent bottle a predetermined distance from the first bottle; and (c) support means for supporting the track in inclined relation tending to gravity feed the bottles toward the front end of the track.

12. A dispensing assembly as defined in claim 11, wherein:

(d) the support means includes front and rear support members each including a plurality of support members; and (e) the track includes U-shaped hangers holding the rails apart and being attachable to associated support members.

13. A dispensing assembly as defined in claim 12, wherein:

(f) the support members each include a plurality of bracket hooks engageable by associated U-shaped hangers.

14. A dispensing assembly as defined in claim 11, wherein:

(d) each rail is upwardly turned at the front end to provide the stop portion.

15. A dispensing assembly as defined in claim 11, wherein:

(d) the gate member includes front and rear bottle engageable cam portions.

16. A dispensing assembly as defined in claim 11, wherein:

(d) spring means biases the gate member rear end into the path of the track.

17. A dispensing assembly as defined in claim 11, wherein:

(d) torsion means mounted to the post biases the gate member rear end into the path of the track.

18. A dispensing assembly as defined in claim 11, wherein:

(d) the gate member rear end portion includes spaced limit means engageable with the rail member to limit movement of the gate member as it rotates about the post.

19. A dispensing assembly as defined including 11 wherein:

(d) the rail members are provided with a low friction coating and are disposed at a 1:8 inclination.

* * * * *